US007189029B2

(12) United States Patent
Pionetti

(10) Patent No.: US 7,189,029 B2
(45) Date of Patent: Mar. 13, 2007

(54) MULTI-CATENARY TYPE RISING COLUMN

(75) Inventor: François-Régis Pionetti, La Baleine (FR)

(73) Assignee: Saipem S.A., Montigny le Bretonneux (FR)

( * ) Notice: Subject to any disclaimer, the term of this patent is extended or adjusted under 35 U.S.C. 154(b) by 0 days.

(21) Appl. No.: 10/514,321

(22) PCT Filed: May 25, 2003

(86) PCT No.: PCT/FR03/01599

§ 371 (c)(1),
(2), (4) Date: Nov. 15, 2004

(87) PCT Pub. No.: WO03/102358

PCT Pub. Date: Dec. 11, 2003

(65) Prior Publication Data

US 2005/0254900 A1 Nov. 17, 2005

(30) Foreign Application Priority Data

May 31, 2002 (FR) ..... 02 06695

(51) Int. Cl.
*E21B 17/01* (2006.01)

(52) U.S. Cl. ..... 405/224.2; 405/168.1; 166/367

(58) Field of Classification Search ..... 405/158, 405/169, 168.1, 168.2, 168.4, 170, 171, 224.2; 166/367
See application file for complete search history.

(56) References Cited

U.S. PATENT DOCUMENTS

| | | | | |
|---|---|---|---|---|
| 3,017,934 | A | 1/1962 | Rhodes et al. | 166/350 |
| 6,146,052 | A | 11/2000 | Jacobsen et al. | 405/169 |
| 6,663,453 | B2 * | 12/2003 | Quigley et al. | 441/133 |
| 2006/0056918 | A1 * | 3/2006 | Luppi | 405/169 |

FOREIGN PATENT DOCUMENTS

| | | |
|---|---|---|
| GB | 2206144 | 12/1988 |
| WO | WO 97/06341 | 2/1997 |

* cited by examiner

*Primary Examiner*—Thomas B. Will
*Assistant Examiner*—Tara L. Mayo
(74) *Attorney, Agent, or Firm*—Cohen Pontani Lieberman & Pavane LLP

(57) ABSTRACT

An undersea pipe of the riser type providing a connection between a floating support and the sea bottom. The riser has a rigid pipe of the catenary type extending from the floating support to a point of contact with the sea bottom. The catenary riser comprises a lower pipe portion terminating at the point of contact. The apparent weight per unit length in water of the lower pipe portion being at least 25% less than that of the remainder of the pipe constituting the catenary riser.

26 Claims, 6 Drawing Sheets

MULTI-CATENARY TYPE RISING COLUMN

This is a U.S. national stage of application No. PCT/FR03/01599, filed on May 27, 2003. Priority is claimed on the following application(s): Country: France, Application No.: 02/06695, Filed: May 31, 2002; the content of which is incorporated here by reference.

FIELD OF THE INVENTION

The present invention relates to a bottom-to-surface connection installation comprising at least one undersea pipe providing a connection between a floating support and the bottom of the sea, in particular at great depths. Such undersea pipes are referred to as "risers" as explained below. Risers are constituted by individual tube elements that are welded or screwed together end to end and that are made out of rigid materials such as steel or composite material.

More particularly, the present invention relates to an undersea pipe of the riser type providing a connection between a floating support and the sea bottom, said riser being constituted by a rigid pipe of the catenary type extending from said floating support to a point where it makes contact with the sea bottom.

BACKGROUND OF THE INVENTION

The technical field of the invention is the field of manufacturing and installing bottom-to-surface production connections for offshore extraction of oil, gas, or other soluble or fusible material, or of a suspension of mineral matter, from an undersea wellhead in order to develop production fields installed offshore, at sea. The main and immediate application of the invention lies in the field of producing oil, and also in the field of reinjecting water, and in the fields of producing or reinjecting gas.

In general, a floating support includes anchor means enabling it to stay in position in spite of the effects of currents, winds, and swell. It generally also has drilling means, oil storage and processing means, and also means for off-loading onto oil-removing tankers which call at regular intervals to remove production. Such floating supports are known as "floating production storage off-loading" supports and the initials "FPSO" are used throughout the description below or else they are known as floating and drilling production units (FDPU) when the floating support is also used for performing drilling operations with a well deflected in the depth of the water.

A catenary riser of the invention may either be a "production riser" for crude oil or gas, or else it may be a water injection riser providing a connection with an underwater pipe resting on the sea bottom, or indeed it may be a "drilling" riser for providing a connection between the floating support and a wellhead located on the sea bottom.

In FPSOs, where multiple lines are generally installed, it is necessary to implement bottom-to-surface connections either of the hybrid tower type, or else of the "catenary" type.

When the bottom-to-surface connection pipe provides a direct connection between a floating support and a contact point on the sea bottom, which point is offset from the axis of said support, the pipe takes up a so-called "catenary" configuration under its own weight, thereby forming a curve whose radius of curvature decreases going down from the surface to the point of contact with the sea bottom, and the axis of said pipe forms an angle $\alpha$ with the vertical whose value lies generally in the range 10° to 20° at the floating support, and varying to reach an angle that is theoretically 90° at the sea bottom, corresponding to an ideal position which is substantially tangential to the horizontal, as explained below.

Catenary type connections are generally made using flexible pipes, but they are extremely expensive because of the complex structure of the pipe.

Thus, it has been the practice to develop substantially vertical risers so as to ensure that the flexible connection in a catenary configuration leading to the floating support is kept close to the surface, thus making it possible to minimize the length of said flexible pipe, and also to minimize the forces which are applied thereto, thereby considerably reducing its cost.

In addition, when producing oil, said crude oil travels over long distances, e.g. several kilometers (km), and it is desirable to provide a very high degree of insulation firstly to minimize any increase in viscosity which would lead to a reduction in the hourly production rate of the well, and secondly to avoid the flow becoming blocked by paraffin being deposited or by hydrates forming when the temperature of the oil drops to around 30° C. to 40° C. These phenomena are all the more critical, particularly off West Africa where the crude oils are of the paraffinic type, given that the temperature of water at the bottom of the sea is about 4° C.

Once the depth of water reaches or exceeds 800 meters (m) to 1000 m, it becomes possible to make said bottom-to-surface connection by means of a thick-walled rigid pipe since the considerable length of the pipe gives it sufficient flexibility to obtain a satisfactory catenary configuration while remaining within acceptable stress limits.

Such rigid risers made of thick strong materials, and disposed in catenary configurations, are commonly referred to as steel catenary risers, and in the present device, the abbreviation "SCR" or the term "catenary riser" are used regardless of whether the material is steel or some other material such as a composite material.

Such SCRs or catenary risers are much simpler to make than are flexible pipes, and they are therefore less expensive.

The geometrical curve formed by a pipe of uniform weight in suspension and subjected to gravity is known as a "catenary" and is a mathematical function of the hyperbolic cosine type ($\text{Cos hx}=(e^x+e^{-x})/2$) relating the abscissa and the ordinate of an arbitrary point along the curve using the following formulae:

$$y=R_0(\cos h(x/R_0)-1)$$

$$R=R_0(Y/R_0+1)^2$$

in which:

x represents the distance in the horizontal direction between said contact point and a point M on the curve;

y represents the height of the point M (x and y are thus the abscissa and the ordinate of a point M on the curve relative to an orthogonal frame of reference whose origin is at said point of contact);

$R_0$ represents the radius of curvature at said point of contact, i.e. at the point where the tangent is horizontal; and R represents the radius of curvature at the point M (x,y).

Thus, curvature varies along the catenary from the surface where its radius has a maximum value $R_{max}$ down to the point of contact where its radius has a minimum value $R_{min}$ (or $R_0$ in the above formula). Under the effect of waves, wind, and current, the surface support moves sideways and vertically, which has the effect of raising and lowering the catenary-shaped pipe at the sea bottom.

Thus, the pipe presents a radius of curvature which is at a maximum at the top of the catenary, i.e. at the point where it is suspended from the FPSO, which radius of curvature is generally at least 1500 m, and in particular lies in the range 1500 m to 5000 m, and it decreases going down to its point of contact on the sea bed. At this location, the radius of curvature is at a minimum in the portion of the pipe that is in suspension. However, in the adjacent portion of the pipe that is lying on the sea bottom, said pipe being ideally in a straight line, the radius of curvature is theoretically infinite. In fact, said radius is not infinite but is extremely large, since some residual curvature remains.

Thus, as the floating support moves on the surface, the point of contact moves forwards and backwards and, in the zone that is lifted off and placed back on the sea bottom, the radius of curvature passes successively from a minimum value $R_{min}$ to a value that is extremely high, and tending to infinity in an ideal configuration where the undersea pipe rests on the sea bottom substantially in a straight line.

This alternating flexing leads to fatigue phenomena that are concentrated throughout the zone constituting the bottom of the catenary, and the lifetime of such pipes is greatly reduced, and is generally incompatible with the lifetimes desired for bottom-to-surface connections, i.e. 20 years to 25 years, or even more.

In addition, it is found that during these alternating movements of the point of contact, the stiffness of the pipe which is associated with the above-mentioned residual curvature will, over time, cause a furrow to be dug over the entire length that is raised and lowered, thereby creating a transition zone in which there exists a point of inflection where the radius of curvature which is at a minimum at the bottom of the catenary then changes sign in said transition zone and increases so as finally to reach an infinite value in the portion of the undersea pipe that is lying in a straight line on the sea bottom.

Such repeated movements over long periods give rise to a furrow of increasing depth in poorly consolidated sea beds of the kind commonly to be found at great depths, thereby modifying the curvature of the catenary and leading, if the phenomenon becomes amplified, to risks of damage to pipes, either where the undersea pipes rest on the sea bottom or else in the SCRs providing the connection between the surface and said undersea pipes resting on the sea bottom.

The most critical portion of the catenary is thus situated in the portion close to the point of contact, and the major fraction of forces in said low portion of the catenary are, in fact, generated by the movements of the floating support and by the excitations which occur in the upper portion of the catenary which is subject to current and to swell, with these excitations then all propagating mechanically along the pipe to the bottom of the catenary.

The currents that occur at the sea bottom, and the influence of swell at that depth, are known to be small and they do not give rise to significant hydrodynamic forces on the low portion of the catenary.

The support floating on the surface possesses considerable buoyancy and remains relatively insensitive to vertical loading generated by catenaries suspended from its side, but in contrast the horizontal tension H created by each of the catenaries must be counterbalanced, either by a balanced distribution of catenaries on the starboard and port sides, or by reinforcing the anchoring of the floating support on its side opposite from the catenaries.

Patent EP 0 952 301 describes an FDPU associated with a catenary bottom-to-surface connection through which a drill string passes, said bottom-to-surface connection serving not only as a guide but also as a return path for drilling mud carrying drilling debris. In the lower portion of said bottom-to-surface connection, where curvature is more accentuated, the rotating drill string rubs against the wall of the bottom-to-surface connection and runs the risk of damaging it, or even destroying it.

Thus, the problem posed is that of providing an undersea bottom-to-surface connection pipe capable of withstanding the fatigue that accumulates at its point of contact with the sea bottom, as created by movements of the support on the surface, and by the effects of swell and current, mainly-in the zone close to the surface where the effects of said swell and said current are generally largest.

This problem is made worse when the structure of the pipe includes a high performance insulation system, which system makes the pipe even more sensitive to problems of fatigue because of the complexity of its internal structure.

Thus, another problem posed is to provide a bottom-to-surface connection pipe in which the horizontal tension at the point of contact with the sea bed and at the level of said floating support is as small as possible, thereby minimizing the unbalance created on the anchoring of the floating support and the phenomena that lead to furrows being created at said point of contact.

Another problem posed is that of providing a bottom-to-surface connection pipe of the drilling riser type presenting improved mechanical characteristics, in particular for the purpose of reducing the risk of damage being caused to the riser by rotating drill strings inserted into the riser and rubbing against the inside wall thereof.

A solution to the problems posed is an undersea pipe of the riser type providing a connection between a floating support and the sea bottom, said riser being constituted by a rigid pipe of the catenary type extending from said floating support to a point of contact with the sea bottom, the pipe being characterized in that said catenary riser comprises a lower pipe portion terminating at said point of contact, the apparent weight per unit length in water of said lower pipe portion being less than that of the remainder of said pipe constituting said catenary riser.

The catenary pipe of the invention thus comprises at least two pipe portions corresponding to two different catenary curves, and it is thus referred to as a multi-catenary pipe.

More particularly, said lightweight lower portion of the pipe extends over a length of at least 100 m from said point of contact.

The lightening of said lower portion of the pipe compared with the remainder of the pipe has the effect of significantly increasing the radius of curvature $R_0$ in the lower portion in the vicinity of the point of contact with the sea bottom, compared with the radius of curvature that would obtain if the lower portion of the pipe presented the same characteristics as said ordinary portion of the pipe. This increase in the minimum radius of curvature at the point of contact has the effect of considerably reducing both fatigue phenomena and also furrow-digging phenomena. During the forward and backward movements of the catenary, the portion of pipe is flexed in alternation to reach its minimum radius of curvature and then be returned substantially to a straight line, which gives rise to alternating stresses that are much smaller in the device of the invention than in the prior art because the minimum radius of curvature is larger, thereby reducing fatigue throughout the lifetime of the pipe, which generally exceeds 25 years. In addition, the furrow created at the bottom of the catenary by the residual curvature is less marked, thereby improving the long-term behavior of the bottom-to-surface connection.

For depths greater than 1000 m, said lightweight lower pipe portion preferably extends over a length lying in the range 200 m to 600 m.

More particularly, said lower pipe portion is lightened so as to have apparent weight per unit length in water that is at least 25%, and preferably 25% to 80% lighter than that of the remaining portion of the pipe which is adjacent thereto.

OBJECT AND SUMMARY OF THE INVENTION

It is also possible to create a said lower pipe portion in accordance with the invention that presents apparent weight per unit length that is less than that of the remainder of the pipe by increasing the weight of the upper portion of the pipe extending from said floating support.

Advantageously, a multi-catenary pipe of the invention thus includes an upper pipe portion which extends from said floating support, said upper pipe portion being made heavier so as to present an apparent weight per unit length that is greater than that of said remaining portion of the pipe which is adjacent thereto.

The effect of increasing the weight of said upper portion of the pipe is to increase its apparent weight in water at said level and thus to increase the tension in said pipe, thereby reducing the angle of inclination between the axis of the pipe and the vertical where the pipe joins the floating support; in addition, increasing the weight of said pipe increases the stability of said upper portion of the pipe, thus making it less sensitive to the effects of current and swell.

Since the excitation at the top of the pipe is reduced, the repercussions thereof at the bottom at the point of contact becomes smaller, thereby correspondingly reducing the amount of movement and thus reducing the fatigue to which the lower portion of the pipe is subjected, which portion is the critical portion of the bottom-to-surface connection, as mentioned above.

Said upper portion of the pipe of increased weight preferably extends over a depth of water corresponding at least to the zone in which the swell has influence, i.e. preferably 150 m to 200 m. In this zone, large currents are generally observed, and these currents are generally substantially uniform in layers of water corresponding to thermoclines. This increases the mass and the apparent weight of the pipe in the upper layer of the water which constitutes the most disturbed zone of the bottom-to-surface connection.

In an embodiment, said upper portion of the pipe that is made heavier presents an apparent weight per unit length that is at least 50% greater than that of the ordinary portion of pipe adjacent to said upper portion, and preferably said apparent weight per unit length is 100% to 300% greater than that of said remaining portion of the pipe which is adjacent thereto.

When said multi-catenary pipe of the invention provides a connection with a sea bottom situated at a depth of at least 1000 m, said upper portion of pipe having increased weight preferably extends over a length of 150 m to 250 m from the surface.

In a preferred embodiment, an upper portion of pipe with increased weight is combined with a lower portion of pipe of reduced weight:

a) a said upper pipe portion of increased weight which extends from said floating support to the top end of a middle pipe portion and of apparent weight per unit length greater than that of said middle pipe portion; and b) a said lower pipe portion of reduced weight which extends from the bottom end of said middle pipe portion to said point of contact at the sea bottom, and of apparent weight per unit length less than that of said middle pipe portion.

More particularly, when said multi-catenary pipe of the invention provides a connection between a floating support on the surface and a point of contact on the sea bed that is situated at a depth of at least 1000 m, it presents:

a) a said upper pipe portion of increased weight extending over a length of 150 m to 250 m from said floating support, corresponding to an increase in weight of 100% to 300% relative to a said middle pipe portion adjacent thereto; and b) a said middle pipe portion of length lying in the range 75% to 120% of the depth of water between said surface and said point of contact; and c) a said lower pipe portion of reduced apparent weight per unit length that is 25% to 80% less than that of said middle pipe portion corresponding to the ordinary portion of said pipe, and extending over a length of 200 m to 600 m from said point of contact.

In an advantageous variant embodiment, said lower portion of pipe is made lighter by increasing its buoyancy using float elements, preferably floats that surround said pipe.

More particularly, said multi-catenary pipe of the invention is constituted by a pipe of the "pipe-in-pipe" type comprising two coaxial pipes, an inner pipe and an outer pipe, and presenting float elements associated therewith, preferably insulating elements, and more preferably elements constituted by syntactic foam around said outer pipe.

In an advantageous variant embodiment, said multi-catenary pipe comprises a said upper pipe portion of increased weight extending from said floating support, said upper pipe portion being made heavier because the thickness of the tubular wall of the steel pipe is greater than the wall thickness in the remainder of the pipe, in particular by using complementary hoops or localized masses that are secured to said portion of increased weight, optionally at regular intervals.

The present invention makes it possible to provide pipes that are stronger, presenting tubular wall thickness greater than the wall thickness of said remaining portion of the pipe adjacent thereto, but in which said lower portion of pipe is of weight that is reduced by floating elements.

In a preferred embodiment, a multi-catenary pipe of the invention comprises at least one transition pipe portion which connects together the top end of said lower pipe portion and the remainder of the pipe, said transition pipe portion presenting intermediate apparent weight per unit length, and preferably of value that varies regularly or progressively in steps between the value of the apparent weight per unit length of said lower pipe portion and the value of the apparent weight per unit length of the main pipe portion adjacent thereto at its other end.

A pipe of the invention may thus comprise the following pipe portions in succession:

a) an upper pipe portion of increased weight;

b) a first transition pipe portion;

c) a middle pipe portion;

d) a second transition pipe portion; and e) a lower pipe portion of reduced weight.

The progressive variation in apparent weight per unit length of said transition pipe portions may be obtained by progressively varying the thickness of the steel tubular well or by progressively varying their buoyancy by varying the quantity of syntactic foam.

Thus, to make said transition pipe portions in which the apparent weight per unit length varies progressively in steps, it is possible to use one or more unit pipe elements of apparent weight, and in particular of wall thickness, that is uniform for each unit element but with values that are intermediate between the values of the adjacent unit elements.

These transition pipe portions may thus extend over lengths of 12 m, 24 m, or 48 m, thereby making it possible to avoid sudden changes of second moment of area which are harmful to good behavior over time with respect to fatigue in the bottom-to-surface connection pipe.

In an advantageous embodiment, said multi-catenary pipe of the invention constitutes a drill riser providing a connection between a derrick placed on said floating support and a wellhead at the sea bottom, or preferably the end of an undersea pipe resting on the sea bottom, itself connected at its other end to said wellhead.

BRIEF DESCRIPTION OF THE DRAWINGS

Other characteristics and advantages of the present invention appear in the detailed light of the following embodiments given with reference to FIGS. 1 to 3.

DETAILED DESCRIPTION OF AN EMBODIMENT

Figure 1:
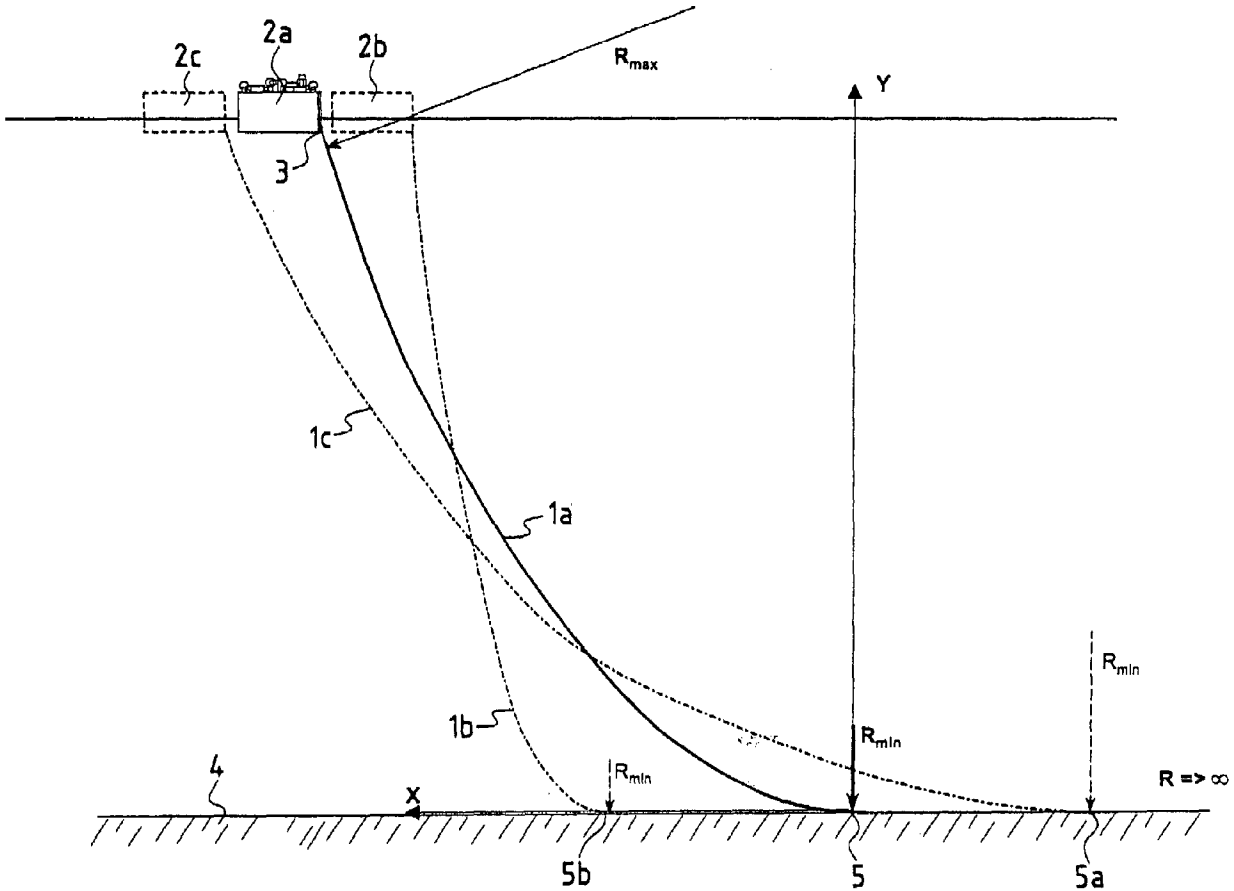
FIG.1 Prior Art
FIG. 1 is a side view of a pipe in a single catenary configuration $\mathbf{1}_a$ suspended from an FPSO type floating support 2 with its bottom end resting on the sea bottom, and shown in three different positions $\mathbf{1}_a$, $\mathbf{1}_b$, and $\mathbf{1}_c$.

Curvature varies along the catenary from the surface, where its radius of curvature has a maximum value $R_{max}$ down to the point of contact where its radius of curvature has a minimum value $R_{min}$. Under the effect of waves, wind, and current, the surface support 2 moves, e.g. from left to right as shown in the figure, thus having the effect of raising and lowering the catenary-shaped pipe, lifting it up from and putting it back down onto the sea bottom. In position $\mathbf{2}_c$, the floating support departs from its nominal position $\mathbf{2}_a$, thereby tensioning the catenary $\mathbf{1}_c$ so as to raise it and move its contact point 5 to the right; the radius of curvature $R_{min}$ at the bottom of the catenary increases, as does the horizontal tension $H_a$ at said point of contact, and also the tension in the pipe at said floating support. Similarly, in position $\mathbf{2}_b$, shifting the floating support to the right has the effect of relaxing the catenary $\mathbf{1}_b$ and lowering a portion of the pipe onto the sea bottom. The radius $R_{min}$ at the point of contact 5 decreases as does the horizontal tension $H_b$ in the pipe at that point, and as does also the tension in the pipe at said floating support. This reduction in the radius of curvature at 5*b* creates considerable internal stresses within the structure of the pipe which can give rise to phenomena of fatigue that accumulate and can lead to the bottom-to-surface connection being destroyed.

Thus, the pipe presents a radius of curvature which is at a maximum at the top of the catenary, i.e. at its point of suspension 3 from the FPSO, and which decreases down to its point of contact 5 with the sea bed 4. At this location, the radius of curvature is at a minimum in the suspended portion, but in the adjacent portion that rests on the sea bottom, said pipe is theoretically in a straight line so its radius of curvature is theoretically infinite. In fact, said radius is not infinite but is extremely large, since there remains a certain amount of residual curvature.

Thus, as explained above, as the floating support 2 on the surface moves about, the point of contact 5 moves from right to left, and in the zone that is lifted off the bottom and lowered back onto the bottom, the radius of curvature passes successively from a minimum value $R_{min}$ to a value that is extremely large, or even infinite for a configuration that is substantially in a straight line.

This alternating bending leads to fatigue phenomena that are concentrated throughout the bottom zone of the catenary, and as a result the lifetime of such a pipe is greatly reduced, and generally incompatible with the lifetime desired for bottom-to-surface connections, i.e. 20 years to 25 years, or even more.

Figure 2:
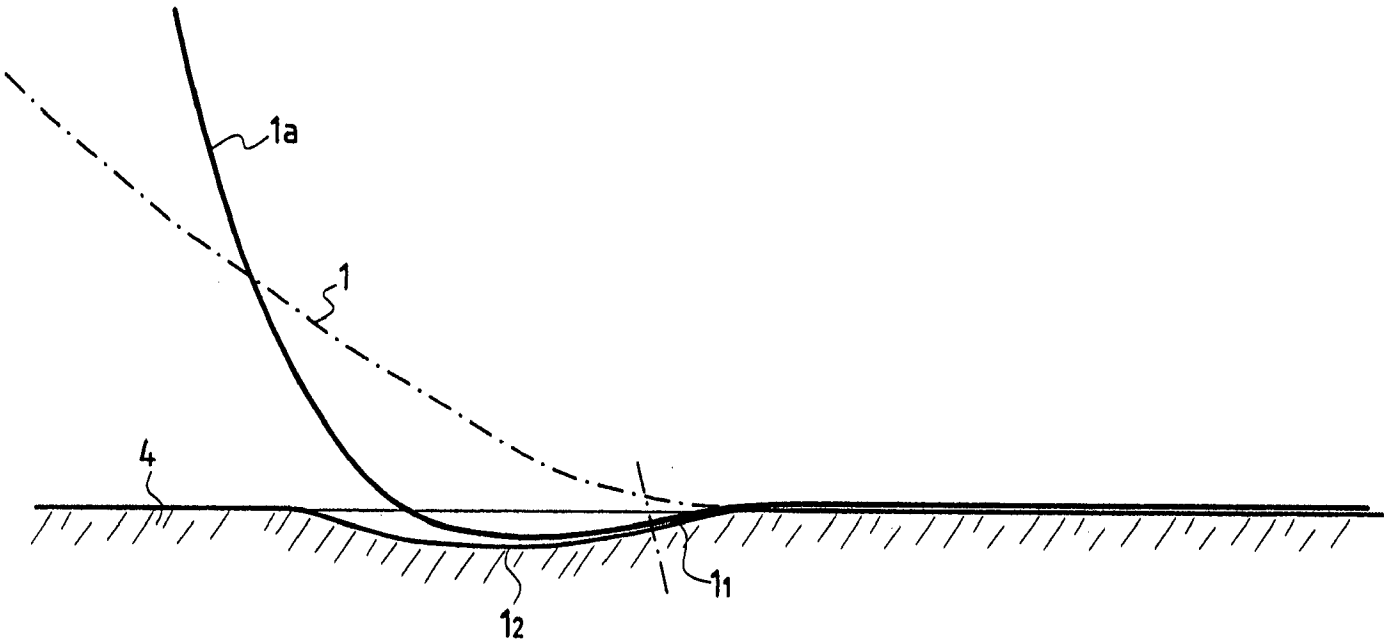
FIG.2 Prior Art
FIG. 2 is a side view in section showing details of the trench dug by the bottom of the catenary during the raising and lowering movements of the pipe on the sea bottom.

In addition, as shown in FIG. 2, it is found that during such alternating movements of the point of contact, the stiffness of the pipe associated with the above-mentioned residual curvature acts over time to dig a furrow 12 over the entire length that is lifted off and then put back down, thereby creating a transition zone in which there exists a point of inflection 11 where curvature changes direction in the transition zones 11*a*–11*b* before finally reaching an infinite value in the portion of the undersea pipe that rests in a straight line on the sea bottom, which portion is lifted up only exceptionally, for example during maximum accumulation in the same direction, to the left, of all of the disturbing elements (swell, wind, current) acting on the floating support and on the catenary, or else in the event of resonance phenomena appearing in the catenary itself.

Figure 4:
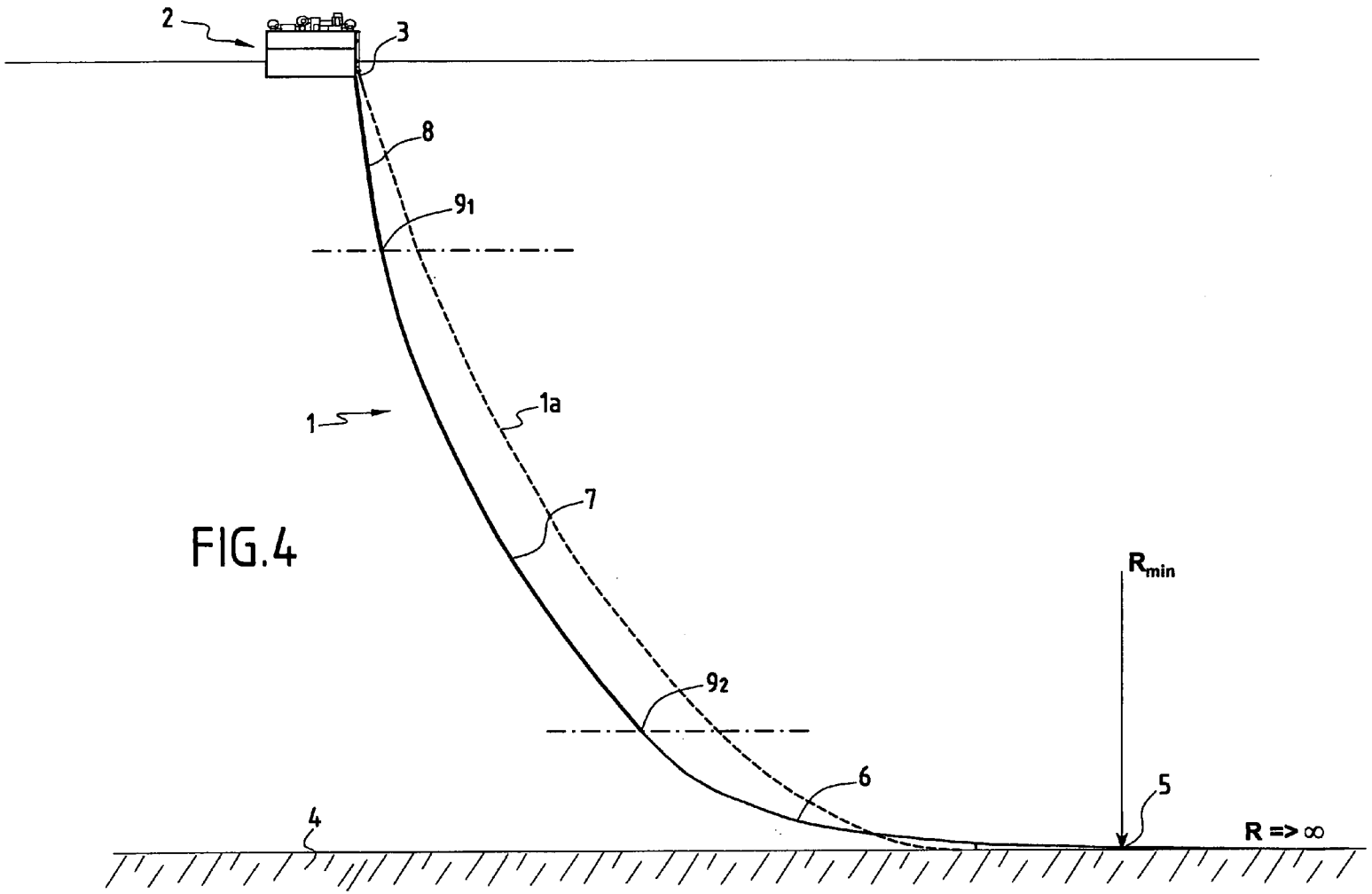
FIGS. 4 and 5 are side views of an FPSO floating support having a multi-catenary pipe of the invention 1 suspended therefrom and presenting three catenary curves (8, 7, 6).

FIG. 4 is a side view of a multiple curvature catenary of the invention constituted in its upper portion by a pipe portion 8 of weight that is increased compared with the ordinary portion 7 situated immediately below it and in continuity therewith, and in its lower portion by a pipe portion 6 of weight that is reduced relative to said ordinary portion 7. In this disposition of the invention, the radius of curvature $R_0$ in the lower portion is significantly increased, thereby considerably reducing the above-explained fatigue phenomena.

In addition, since the upper portion 8 is heavier it presents higher tension, thereby increasing the stability of the upper portion of said catenary correspondingly, so that it becomes less sensitive to the effects of current and swell, where the effects of swell can be significant down to depths of 100 m to 150 m below the surface. Since top excitation is reduced, the repercussions thereof at the bottom 5 of the catenary are also smaller, thereby correspondingly reducing movement, and thus fatigue in this critical lower portion 6 of the bottom-to-surface connection.

Figure 5:
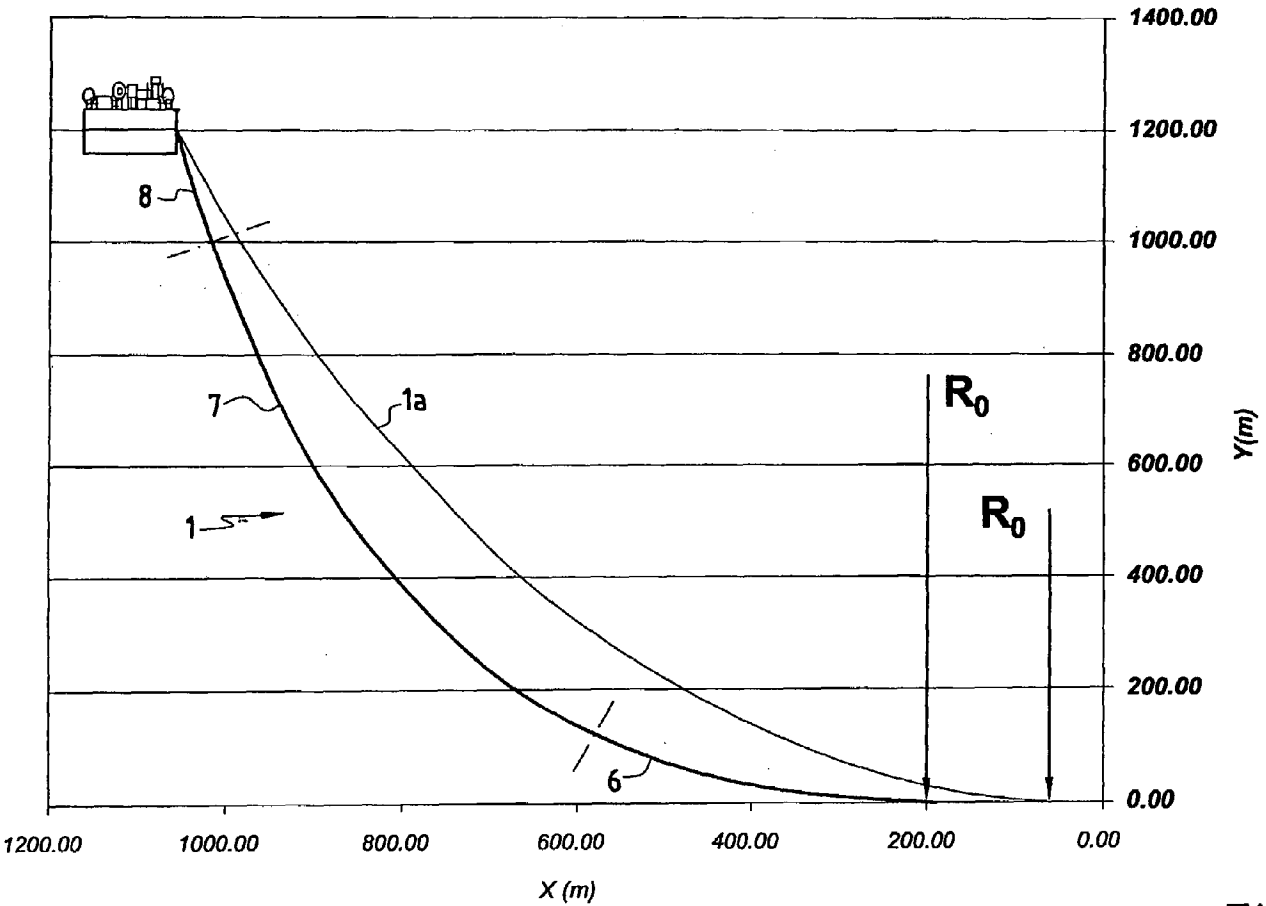

By way of illustration, a single catenary $\mathbf{1}_a$ (FIGS. 1 and 5) installed in water having a depth of 1200 m is constituted by a pipe-in-pipe type pipe having an outside diameter of 323.85 mm, apparent weight per unit length in water $\omega$=177.42 kilograms per meter (kg/m) and presenting a radius of curvature $R_0$ (=$R_{min}$) at the point of contact 5, such that $R_0$=500 m, which corresponds to a pipe that presents acceptable behavior with respect to fatigue over time. The horizontal tension H at the point of contact is H=89 (metric) tonnes, and the head angle relative to the vertical is $\alpha$=17.1°.

The floating support 2 on the surface is thus likewise subjected to the same horizontal tension at the other end of the pipe, i.e. H=89 tonnes, and its anchoring on its side opposite to the bottom surface link must be reinforced correspondingly.

A multi-catenary pipe 1 of the invention, i.e. constituted in this case by three different catenary curves (FIGS. 4 and 5) is constituted by the following:

a middle portion 7 of the pipe as described above, occupying a length of 1000 m;

an upper portion 8 of increased weight over 200 m suspended from the floating support 2, being made heavier by increasing the thickness of steel so as to achieve an apparent weight per unit length in water $\omega$=440.45 kg/m; and a lower pipe portion 6 of weight that is reduced by adding float elements of the syntactic foam type to achieve an apparent weight per unit length in water of $\omega$=68.13 kg/m.

The lower portion 6 presents a radius of curvature at the point of contact $R_0$=733.9 m, which leads to a horizontal tension of 50 tonnes.

The table below compares the main results relating to the single catenary pipe and to the multi-catenary pipe of the invention.

| Depth of water: 1200 m | Single catenary pipe | Multi-catenary pipe |
|---|---|---|
| $R_0$ at point of contact | 500 m | 733.9 m |
| Horizontal tension H | 89 tonnes | 50 tonnes |
| Head angle $\alpha$ | 17.1° | 9.6° |
| Head tension T | 301.6 tonnes | 300.5 tonnes |
| Distance from floating support to point of contact 5 | 947 m | 903.8 m |

As a general rule, and by way of non-limiting illustration, an upper portion 8 is used that presents a length of 150 m to 250 m that is 100% to 300% heavier than the middle, ordinary portion 7 situated immediately below it, the length of the middle, ordinary portion 7 being, for example, 75% to 120% of the depth of the water, the lower pipe portion 6 being 25% to 80% lighter than the middle ordinary portion 7, and presenting a length of 200 m to 600 m, extending on the sea bottom 4 beyond the point of contact 5 over several tens or indeed several hundreds of meters. Thus, during backward and forward movements of the floating support 2, the lower portion 6 of the catenary that is raised is always of the lightened type and never of the type corresponding to the undersea pipe resting on the sea bottom and connected to the wellheads.

A multi-catenary pipe 1 of the invention thus presents the following advantages:

a radius of curvature $R_0$ at the bottom of the catenary that is increased by about 50%, thereby providing the pipe with considerably improved fatigue behavior over time;

a horizontal tension force at the point of contact, and thus a horizontal tension force at the top on the floating support that are substantially halved, thereby dramatically reducing the unbalance of the anchoring of said floating support 2; and the departure of the axis of the pipe from the vertical is considerably reduced, the angle of the axis of the pipe relative to the vertical at the floating support being $\alpha$=9.6° instead of $\alpha$=17.1° in a prior art pipe $\mathbf{1}_a$.

Figure 3:
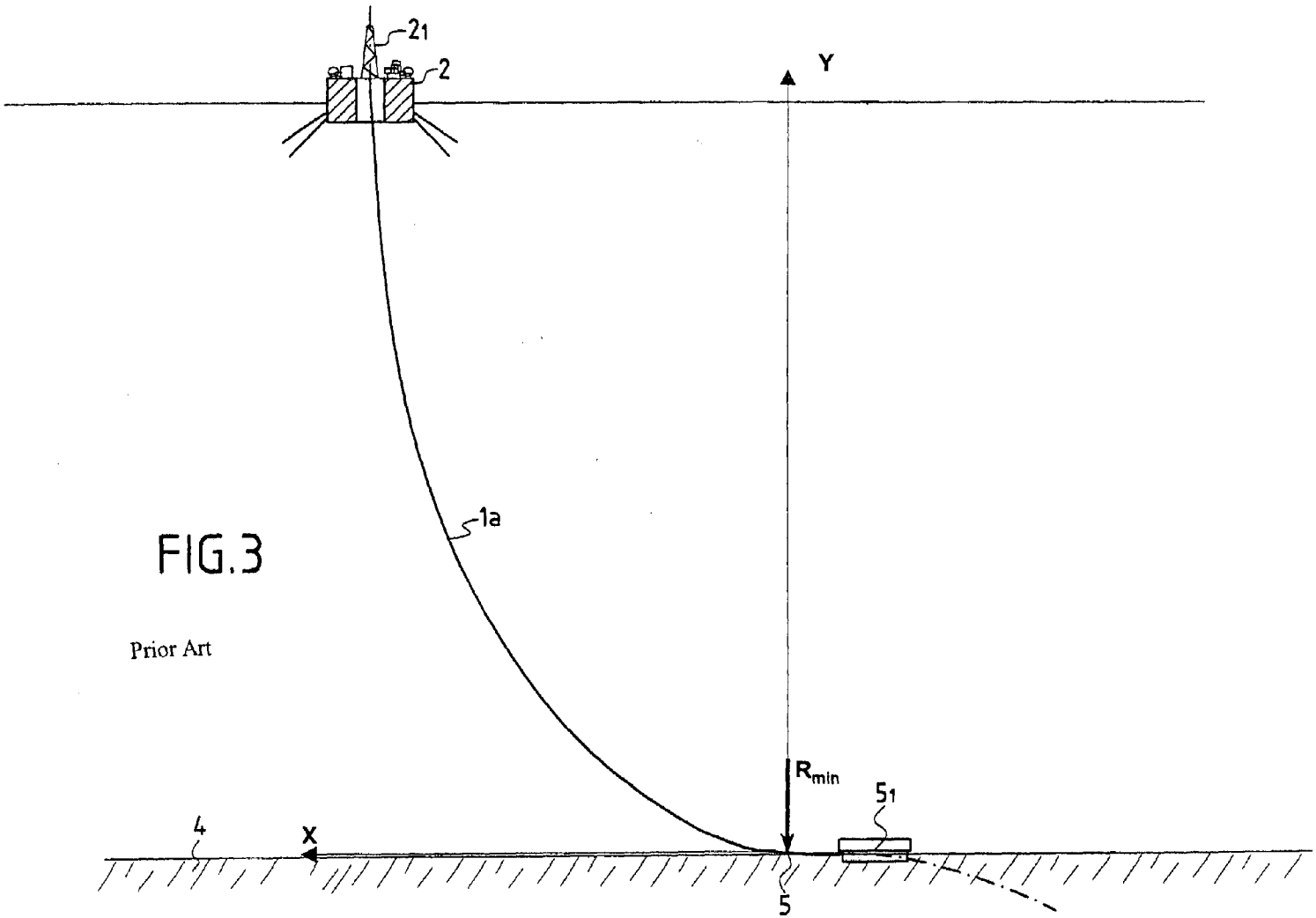
FIG.3 Prior Art
FIG. 3 is a side view of the pipe in a single catenary configuration $\mathbf{1}_a$ suspended from a drilling and operating floating support of the FDPU type, and having its bottom end resting on the sea bed prior to penetrating into the ground to reach oil-bearing layers.

In FIG. 3, there can be seen a side view of an FDPU type floating support 3 comprising a bottom-to-surface connection $\mathbf{1}_a$ in a drilling riser catenary configuration connecting the base of the drilling derrick $\mathbf{2}_1$ to a device $\mathbf{5}_1$ situated on the sea bottom, said device serving to guide the pipe in the zone where it penetrates into the sea bed. Said drilling riser $\mathbf{1}_a$ has the function of guiding the drill string that is actuated by and manipulated from said drilling derrick $\mathbf{2}_1$, with drilling mud returning in the space that exists between said drill string and said drilling riser. In the prior art, the drill string is highly curved in the lower portion of the catenary and tends to rub against the walls of the drilling riser, thereby significantly increasing wear and the risk of damage to said riser. The multi-catenary pipe of the invention thus makes it possible not only to reduce problems of fatigue in the bottom zone of the riser by increasing the bottom radius of curvature, but also to reduce wear inside said drilling riser due to the effect of friction between the rotating drill string and the wall of said riser. Fatigue in the drill string itself is also considerably reduced because of the reduction in the curvature in the bottom zone of the catenary of the drilling riser; similarly, the power needed for drilling proper is greatly reduced.

The device of the invention thus makes it possible to improve the fatigue behavior of the drilling riser in the bottom zone of the catenary, to reduce phenomena associated with wear due to the drill string rotating inside said riser, and to improve significantly the alignment at the FDPU between said drilling riser and said derrick.

When the multi-catenary pipe of the invention is a drilling riser which extends from an FDPU floating support having a derrick $\mathbf{2}_1$, the increase in weight of the upper portion 8 and the length thereof are advantageously increased so as to minimize the angle $\alpha$ between the axis of the pipe and the vertical at the floating support 2, thereby reducing the misalignment between the axis of the pipe and the axis of the derrick $\mathbf{2}_1$, thus making it easier to insert drilling rods and to perform drilling operations in general.

In the same manner, it is advantageous to increase the thickness of steel in the lower portion 6 of the riser in order to reduce the risk of wear due to friction against the drill string, insofar as this additional weight is compensated by increasing the float elements, e.g. shells of syntactic foam so as to obtain a mean weight in water as described above.

At the connections between two types of catenary, steps are taken to avoid creating a sudden change in second moment of area which would be harmful to good behavior of the bottom-to-surface connection over time with respect to fatigue, and it is advantageous to incorporate transition pipe portions at $\mathbf{9}_1$ and $\mathbf{9}_2$, e.g. over a length of 12 m, 24 m, or 48 m, in which the thickness of the pipe increases progressively or in steps from a lower portion towards a higher portion, and/or progressively integrating float elements so that the lower portion of the "transition" pipe is lighter than the upper portion thereof.

Figure 6:
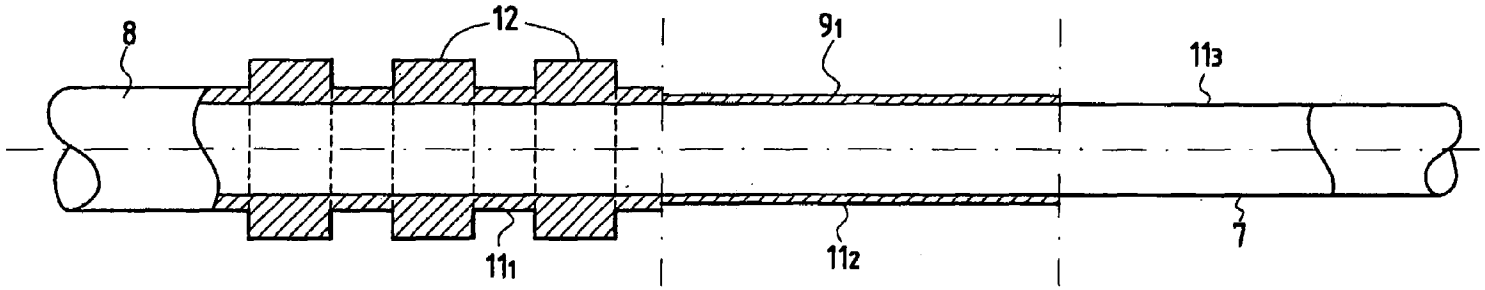
FIG. 6 is a side view in exploded section of the transition zone between the upper pipe portion 8 and the intermediate portion 7.

FIG. 6 shows the transition zone $\mathbf{9}_1$ between the upper portion constituted by a pipe 8 made heavier by increasing the thickness of its wall $\mathbf{11}_1$ and by adding hoops 12 spaced apart (optionally in regular manner), and the portion of pipe 7 of smaller wall thickness $\mathbf{11}_3$. Said transition zone $\mathbf{9}_1$ is provided by a 24 m length of pipe having wall thickness $\mathbf{11}_2$ lying between the values $\mathbf{11}_1$ and $\mathbf{11}_3$, and preferably equal to the average of said two values.

It remains within the spirit of the invention for the mass per unit length of the pipe to be increased by means of localized loads that are secured to the pipe, along the upper pipe portion 8 (and optionally uniformly distributed), as a replacement for or in combination with an increase in the wall thickness $\mathbf{11}_1$ or the hoops 12 as described above.

Figure 7:
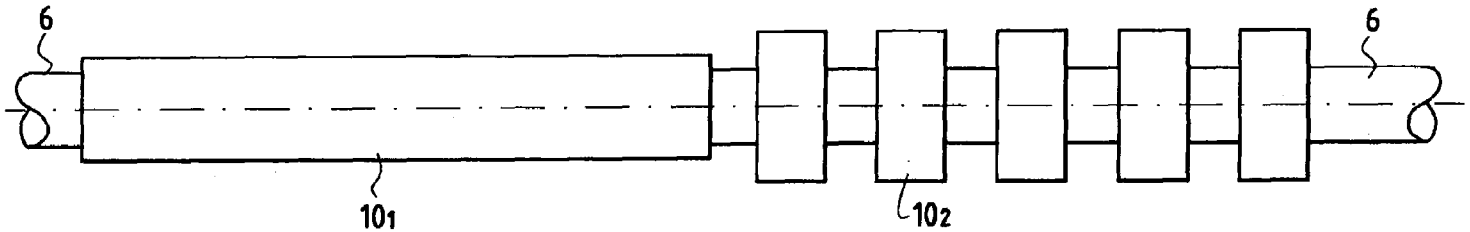
FIG. 7 is a side view of the lightening of the lower portion by means of floats that are continuous or distributed about the pipe.

FIG. 7 shows the pipe portion 6 of reduced weight fitted on the left-hand side of the figure with a continuous float element of great length $\mathbf{10}_1$ constituted by shells of syntactic foam, and on the right-hand side of the figure with individual float elements $\mathbf{10}_2$ that are regularly spaced apart and that give the same mean buoyancy per meter of pipe as does said continuous element $\mathbf{10}_1$.

The invention claimed is:

1. An undersea pipe of the riser type providing a connection between a floating support and the sea bottom, said riser being constituted by a rigid pipe of the catenary type suspended in the water subjected to gravity and extending between the surface and the sea bed, with a portion of the riser resting substantially horizontally on the sea bed, the curvature of the riser in suspension is such that the curvature radius of the riser decreases from the surface wherein the curvature radius has a maximum value, down to the point of contact of the riser with the sea bed where the curvature radius has a minimum value, the pipe being characterized in that said catenary riser comprises at least two pipe portions corresponding to two different catenary curves, one of said portions being a lower pipe portion terminating at said point of contact, the apparent weight per unit length in water of said lower pipe portion being at least 25% less than that of the remainder of said pipe constituting said catenary riser.

2. A pipe according to claim 1, characterized in that said lower pipe portion of reduced weight extends over a length of at least 100 m from said point of contact.

3. A pipe according to claim 2, characterized in that said pipe provides a connection with a sea bottom at a depth of at least 1000 m, and said lower pipe portion of reduced weight extends over a length of 200 m to 600 m.

4. A pipe according to claim 1, characterized in that said pipe provides a connection with a sea bottom at a depth of at least 1000 m, and said lower pipe portion of reduced weight extends over a length of 200 m to 600 m.

5. A pipe according to claim 4, characterized in that said lower pipe portion is lightened with an apparent weight per unit length in water that is at least 25% and preferably 25% to 80% less than that of the portion of the remainder of the pipe which is adjacent thereto.

6. A pipe according to claim 5, characterized in that said lower pipe portion is lightened with an apparent weight per unit length in water that no more than about 80% less than that of the portion of the remainder of the pipe which is adjacent thereto.

7. A pipe according to claim 1, characterized in that said pipe includes an upper pipe portion which extends from said floating support, said upper pipe portion being of weight that is increased so as to present an apparent weight per unit length that is greater than that of said remaining portion of the pipe which is adjacent thereto.

8. A pipe according to claim 7, characterized in that said upper pipe portion of increased weight extends through a depth of water corresponding at least to the zone that is influenced by swell.

9. A pipe according to claim 7, characterized in that said upper pipe portion of increased weight presents apparent weight per unit length that is at least 50% greater than that of the portion of the remainder of the pipe that is adjacent to said upper portion.

10. A pipe according to claim 9, characterized in that said pipe constitutes a drilling riser providing the connection between a derrick placed on said floating support and the end of an undersea pipe resting on the sea bottom, itself connected at its other end to a wellhead.

11. A pipe according to claim 7, characterized in that said pipe provides a connection with a sea bottom situated at a depth of at least 1000 m, and said upper pipe portion of increased weight extends over a length of 150 m to 250 m from the surface.

12. A pipe according to claim 11, characterized in that said pipe presents:

a) a said upper pipe portion of increased weight which extends from said floating support to the top end of a middle pipe portion and of apparent weight per unit length greater than that of said middle pipe portion; and b) a said lower pipe portion of reduced weight which extends from the bottom end of said middle pipe portion to said point of contact at the sea bottom, and of apparent weight per unit length less than that of said middle pipe portion.

13. A pipe according to claim 12, characterized in that said pipe provides a connection between a floating support on the surface and the point of contact at the sea bottom situated at a depth of at least 1000 m, and it presents:

a) a said upper pipe portion of increased weight extending over a length of 150 m to 250 m from said floating support, corresponding to an increase in weight of 100% to 300% relative to a said middle pipe portion adjacent thereto; and b) a said middle pipe portion of length lying in the range 75% to 120% of the depth of water between said surface and said point of contact; and c) a said lower pipe portion of reduced apparent weight per unit length that is 25% to 80% less than that of said middle pipe portion corresponding to the ordinary portion of said pipe, and extending over a length of 200 m to 600 m from said point of contact.

14. A pipe according to claim 13, characterized in that said lower pipe portion is lightened by increasing its buoyancy by means of float elements associated with said pipe.

15. A pipe according to claim 14, characterized in that float elements comprise syntactic foam.

16. A pipe according to claim 11, characterized in that said pipe presents:

a) a said upper pipe portion of increased weight which extends from said floating support to the top end of a middle pipe portion and of apparent weight per unit length greater than that of said middle pipe portion; and b) a said lower pipe portion of reduced weight which extends from the bottom end of said middle pipe portion to said point of contact at the sea bottom, and of apparent weight per unit length less than that of said middle pipe portion.

17. A pipe according to claim 7, characterized in that said upper pipe portion of increased weight extends through a depth of water of about 150 m to about 200 m.

18. A pipe according to claim 7, characterized in that said upper pipe portion of increased weight presents apparent weight per unit length that is about 100% to about 300% greater than that of said portion of the remainder of the pipe that is adjacent thereto.

19. A pipe according to claim 1, characterized in that said pipe is constituted by a pipe-in-pipe type pipe comprising two coaxial pipes, an inner pipe and an outer pipe, including insulating float elements.

20. A pipe according to claim 19, characterized in that said pipe comprises an upper pipe portion of increased weight extending from said floating support, said upper pipe portion being made heavier because the thickness of the tubular wall of the steel pipe is greater than that of the remainder of the pipe.

21. A pipe according to claim 20, characterized in that said lower pipe portion of reduced weight is lightened by float elements and presents a tubular wall thickness that is greater than the wall thickness of said pipe portion that is adjacent thereto.

22. A pipe according to claim 21, characterized in that said pipe comprises at least one transition pipe portion providing a connection between the top end of said lower pipe portion and the remainder of the pipe, said transition pipe portion presenting apparent weight per unit length that varies regularly or progressively in steps between the value of the apparent weight per unit length of said lower pipe portion and the value of the apparent weight per unit length of the portion of the remainder of the pipe which is adjacent to its other end.

23. A pipe according to claim 22, characterized in that said pipe constitutes a drilling riser providing the connection between a derrick placed on said floating support and a wellhead at the sea bottom.

24. A pipe according to claim 19, characterized in that said float elements comprise syntactic foam disposed around said outer pipe.

25. A pipe according to claim 1, characterized in that said pipe includes an upper pipe portion which extends from said floating support, said upper pipe portion being of weight that is increased so as to present an apparent weight per unit length that is greater than that of said remaining portion of the pipe which is adjacent thereto.

26. A pipe according to claim 1, characterized in that said lower pipe portion is lightened with an apparent weight per unit length in water that is about 25% to about 80% less than that of the portion of the remainder of the pipe which is adjacent thereto.

* * * * *